US006611203B2

(12) United States Patent
Whitmore et al.

(10) Patent No.: US 6,611,203 B2
(45) Date of Patent: Aug. 26, 2003

(54) SPRAY GUN CONTROL OPERATOR INTERFACE

(75) Inventors: Lynne M. Whitmore, Maple Heights, OH (US); James M. Khoury, Strongsville, OH (US); John C. Dillon, Lorain, OH (US); Lenzie Borders, Jr., Cleveland Heights, OH (US); Mark Wilson, Elyria, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/942,011

(22) Filed: Aug. 29, 2001

(65) Prior Publication Data

US 2002/0063636 A1 May 30, 2002

Related U.S. Application Data

(60) Provisional application No. 60/229,413, filed on Aug. 31, 2000.

(51) Int. Cl.[7] ..... G08B 29/00

(52) U.S. Cl. ..... 340/506; 340/524; 340/525; 340/606; 345/708; 345/810

(58) Field of Search ..... 340/506, 515, 340/524, 525, 603, 606, 3.1, 825.22; 345/708, 810, 839, 866, 854

(56) References Cited

U.S. PATENT DOCUMENTS 3,400,891 A 9/1968 Mattwell ..... 239/66
4,456,983 A * 6/1984 Schoonover ..... 367/69
4,481,503 A 11/1984 Lehman et al. ..... 340/58
4,668,948 A 5/1987 Merkel ..... 340/825
4,937,746 A 6/1990 Brundisini ..... 364/420
5,331,831 A * 7/1994 Schneider ..... 72/4
5,347,453 A * 9/1994 Maestre ..... 705/2
5,392,207 A * 2/1995 Wilson et al. ..... 700/64
5,495,961 A * 3/1996 Maestre ..... 221/3
5,504,693 A 4/1996 Elliott et al. ..... 364/510
5,926,176 A * 7/1999 McMillan et al. ..... 345/764
5,999,106 A * 12/1999 Buckler ..... 340/870.09
6,176,391 B1 * 1/2001 Rehkemper et al. ..... 221/8
6,219,046 B1 * 4/2001 Thomas et al. ..... 345/708
6,326,962 B1 * 12/2001 Szabo ..... 345/762

* cited by examiner

*Primary Examiner*—Daryl Pope
(74) *Attorney, Agent, or Firm*—Calfee, Halter & Griswold LLP

(57) ABSTRACT

A monitoring system that permits an operator to observe on a visual display operating data for a plurality of dispensing devices. These data displays are visual representations based on signals received from a monitor control. The operator is able to arrange and group the displays of a plurality of dispensing devices as required. In one embodiment, the visual representations include graphical representations of a characteristic of the dispensed fluid on a time line, such as a pressure reading for example. Such graphical representations may include alarm limits or bands. Each visual representation may include fault indications that are time and date stamped. The visual representations may also be color coded to indicate normal and fault conditions. All of this monitoring may conveniently be performed at a location that is remote from the dispensing devices. The collected information may be logged for later analysis such as exporting the data to another program such as a spreadsheet database.

18 Claims, 7 Drawing Sheets

SPRAY GUN CONTROL OPERATOR INTERFACE

RELATED APPLICATION

This application claims the benefit of U.S. provisional patent application serial No. 60/229,413 filed on Aug. 31, 2000 for CANWORKS® OPERATOR INTERFACE TRACKING PLUS, the entire disclosure of which is fully incorporated herein by reference.

FIELD OF THE INVENTION

The present invention is directed to the art of dispensing fluid materials and systems for monitoring the dispensing apparatus. More particularly, the invention is directed to improvements in monitoring systems for such apparatus to improve the ability to detect system anomalies.

BACKGROUND OF THE INVENTION

Fluids may be applied to any number of objects and surfaces by a variety of dispensing techniques including spraying. Dispensing systems typically include a dispensing device that may have a nozzle that produces a desired pattern, a pump and other related devices. It is often desirable to be able to monitor various flow characteristics of the fluid within the dispensing system in order to detect system malfunctions or wearing parts. One such monitoring system is described in U.S. Pat. No. 5,999,106 (the "'106 patent") issued to Buckler, owned in common with the assignee of the present invention, the entire disclosure of which is fully incorporated herein by reference. The cited patent may be referred to for exemplary details of the fluid dispensing system and basic monitoring system. This system has enjoyed commercial success by permitting an operator to monitor from a remote location a flow characteristic of the fluid being dispensed. The present invention is directed to further improvements of the '106 patent.

SUMMARY OF THE INVENTION

The present invention provides in a first embodiment a monitoring system that permits an operator to observe on a visual display operating data for a plurality of dispensing devices. These data displays are visual representations based on signals received from a monitor control. The operator is able to arrange and group the displays of a plurality of dispensing devices as required. In one embodiment, the visual representations include graphical representations of a characteristic of the dispensed fluid on a time line, such as a pressure reading for example. Such graphical representations may include alarm limits or bands. Each visual representation may include fault indications that are time and date stamped. The visual representations may also be color coded to indicate normal and fault conditions. All of this monitoring activity may conveniently be performed at a location that is remote from the dispensing devices. The collected information may be logged in memory for later analysis such as exporting the data to another program such as a spreadsheet or database.

Various other embodiments of the invention are described and claimed herein, and other features and advantages of the present device will become apparent from the following detailed description, with reference to the accompanying drawings and claims, which form a part of the specification.

DETAILED DESCRIPTION

Figure 1:
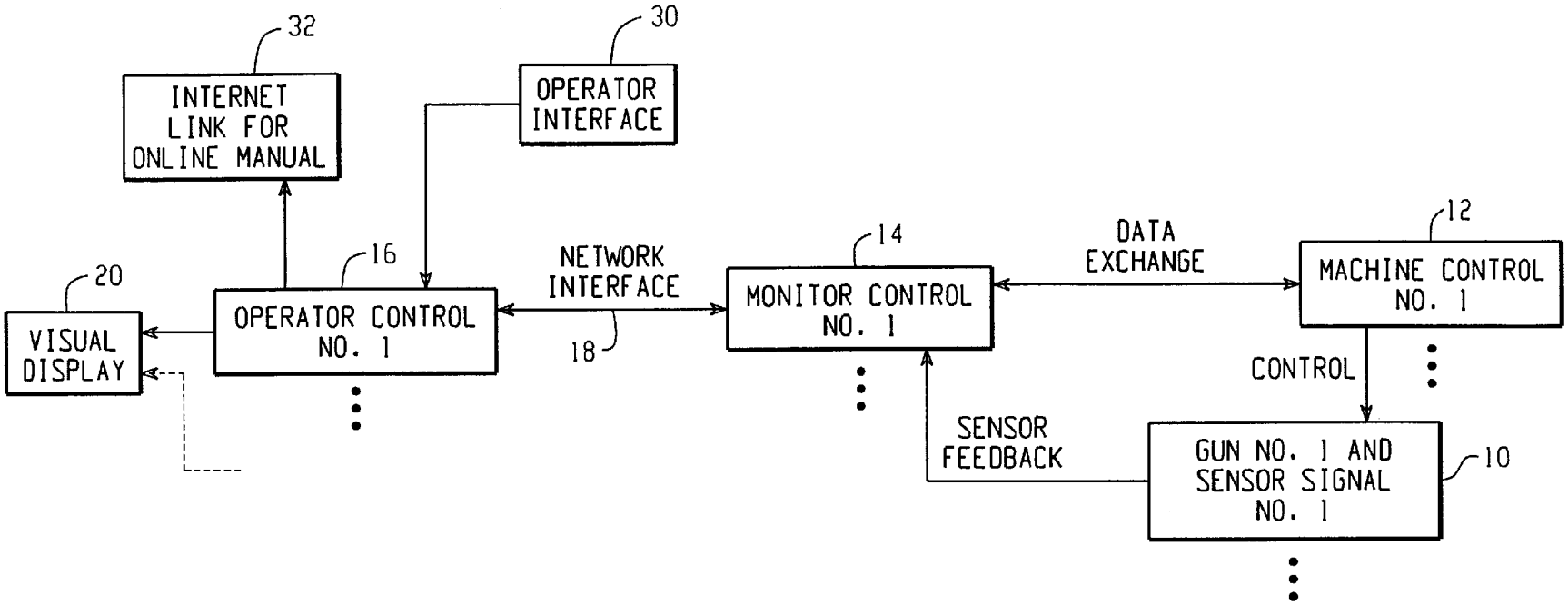
FIG. 1 is a simplified functional block diagram of a fluid dispensing system such as may be used with the present invention.

With reference to FIG. 1, the present invention is described herein in terms of the system described in the '106 patent. However, such description is intended to be exemplary in nature and should not be construed in a limiting sense. The present invention may be used in different systems wherein a plurality of fluid dispensing devices are electronically monitored.

Figure 3:
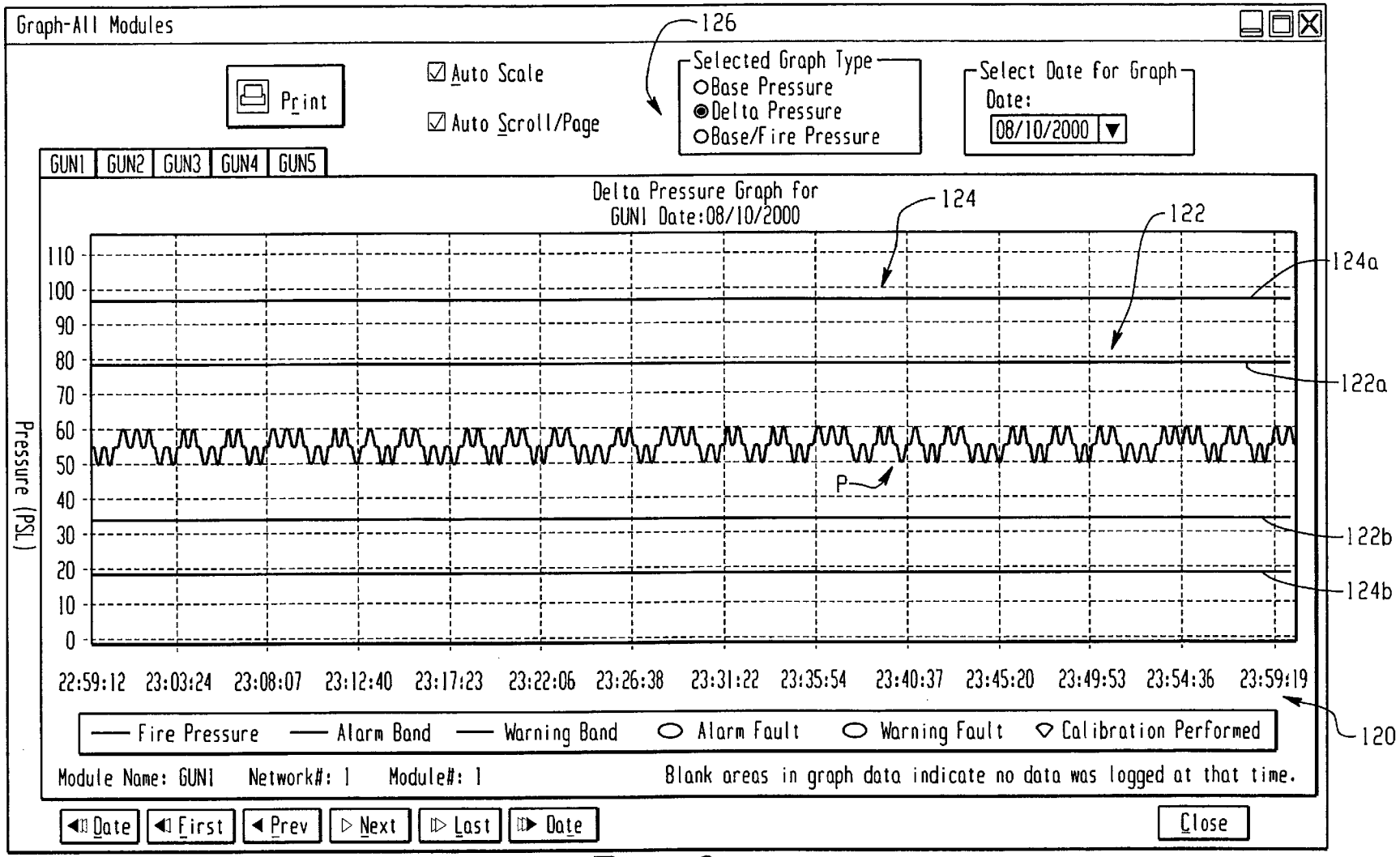
FIG. 3 is another visual representation of data in graphic form including alarm limits for a signal monitored during operation of the system of FIG. 1, showing a dispensing device operating within a range of limits.

FIG. 1 herein is a simplified functional block diagram of FIG. 3 of the '106 patent including modifications in accordance with some aspects of the present invention. Reference may be made to the '106 patent for particular details of the system, however, such a detailed description is not necessary to understand and practice the present invention.

The fluid dispensing monitoring system illustrated in FIG. 1 includes a plurality of dispensing devices 10, such as fluid spray guns. Although the present invention is described herein with reference to a plurality of spray guns as the dispensing devices, such description is exemplary in nature. The present invention may be used with any conveniently available dispensing device. Operation of each device 10 is individually controllable by a respective machine control circuit 12. At least one characteristic or parameter such as pressure of the fluid being dispensed is detected and converted to a corresponding electrical signal or signals by a respective monitor control circuit 14. The monitor control 14 may provide warning or alarm signals to the machine control 12.

As noted in the '106 patent, the monitor control 14 provides the corresponding signal that is representative of the detected fluid flow characteristic to a respective operator control circuit 16 across a suitable network 18. This permits an operator to monitor a dispensing device 10 operation from a location that is remote from the dispensing device.

In the '106 patent, the operator control 16 provides a monochrome LCD type display to permit the operator to observe text information for only four guns 10 without independent grouping on a screen. In many systems, there are a plurality of guns used wherein it may be desirable for an operator to observe data on more than one gun at a time. The '106 system includes colored LED's for alarms and warnings, however, such indicators were not identified to a specific gun fault. The present invention therefore is directed to improvements in the operator control 16.

The specific implementation of the present invention may be realized with any conveniently available computer and software platform. In one embodiment, the invention is realized using a desktop personal computer running on a Microsoft™ WINDOWS™ operating system. Conventional software programs such as Microsoft Excel™ may be used to analyze data including graphing, or separate software programs may be written as required for a particular application. The operator control 16 will include in a preferred embodiment a visual display 20 such as a color monitor connected to the personal computer. An operator interface 30 such as a keyboard, mouse and so forth is provided for data input such as is needed for configuring the system or updating and making changes. As will be explained hereinafter, the system may be provided with a link 32 to an Internet web site for access to an online manual.

Figure 2:
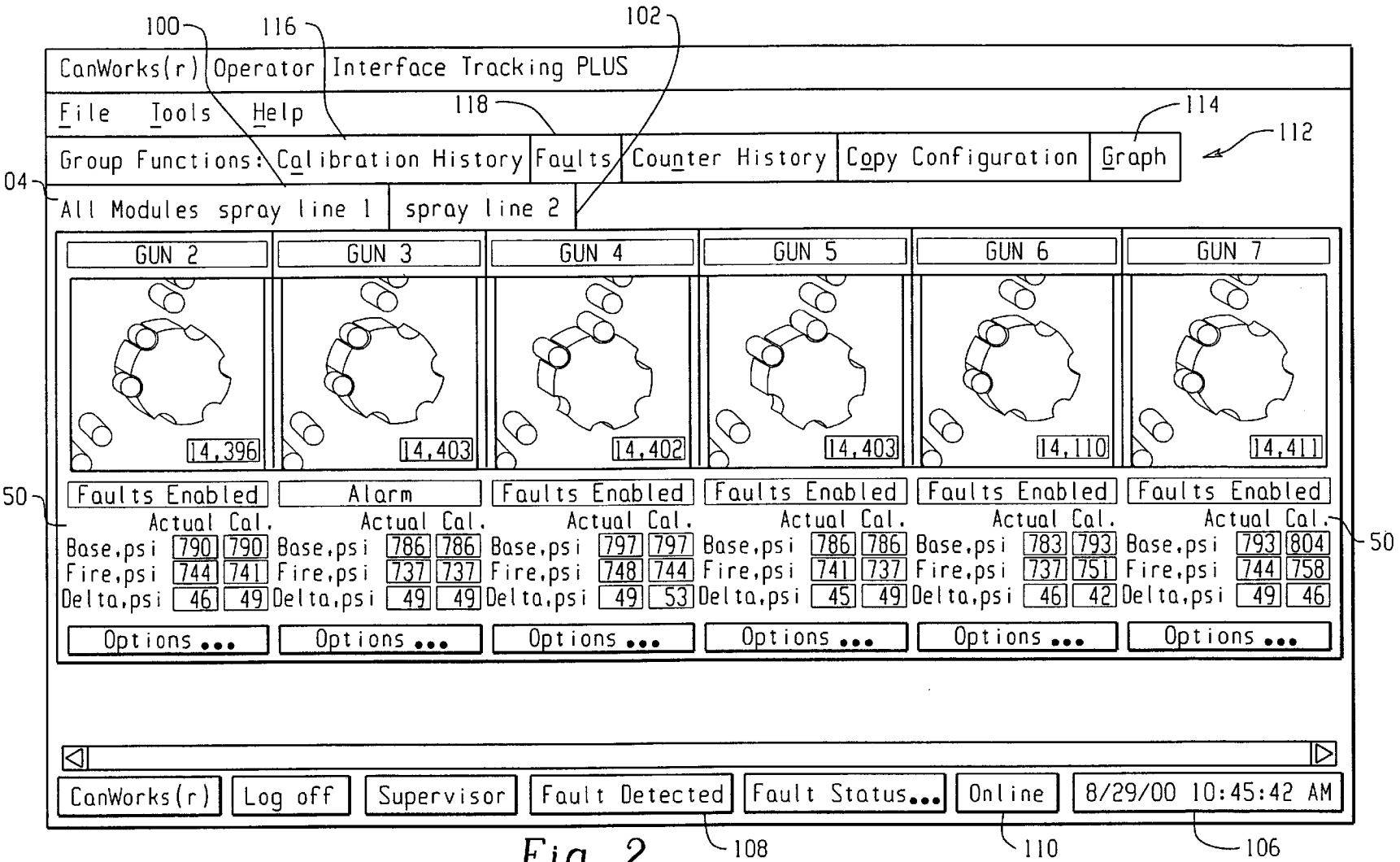
FIG. 2 is a visual representation of data for monitoring operation of a plurality of dispensing devices such as are used in the system of FIG. 1.
Figure 4:
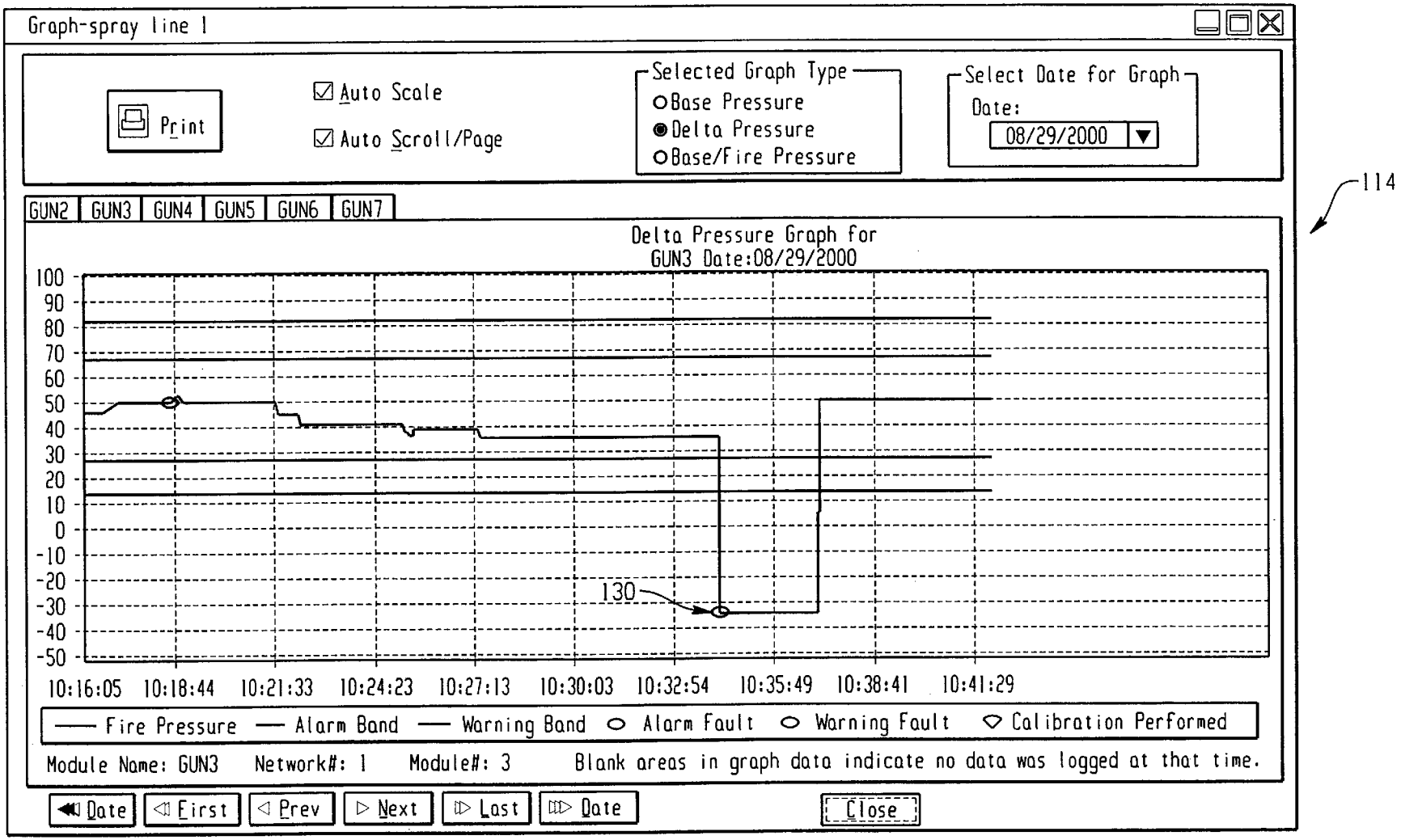
FIG. 4 is similar to FIG. 3 but illustrating a fault condition and its representation in the visual graphical representation.

With reference to FIGS. 2–4, in accordance with one aspect of the invention, the monitored signals, such as for example a dispensed fluid pressure signal for each dispensing device 10, are visually represented on the computer's visual display. The form and appearance of the visual representation may be programmed according to the specific monitoring function to be carried out, but in general it is contemplated that at least one screen or window will allow the operator to select and group data for a plurality of dispensing devices 10 to observe at the same time without having to scroll through a series of screens. Thus for example in FIG. 1, pressure data for each of a plurality of dispensing devices or guns 10 is visually represented as a separate selectable data box or faceplate 50. In this example, the operator has grouped guns 2–7 together for visual representation under a group tab 100 for spray line 1 since all these particular guns are used on a single spray line. Additional groupings such as for a second spray line 102 may be used, as well as an all modules tab 104 for showing all the guns on a single screen. The faceplates 50 within a particular grouping may be tiled or otherwise arranged in a desired appearance.

Groupings may be carried out by "drag and drop" or "cut and paste" techniques or any other suitable method. Each faceplate 50 in this example provides pressure data of interest in this particular application such as base pressure or the pressure when the gun is not dispensing, fire pressure when the gun is opened to dispense, and a delta pressure reading that is the calculated difference between the two. In accordance with another aspect of the invention, each faceplate 50 are coded to visually alert an operator to a fault condition. In the embodiment of FIG. 2, each faceplate 50 is framed in a green color if the gun is operating within prescribed limits and is framed in red if an alarm condition or fault has been detected. Yellow, for example, may be used as a warning indication. The red condition is maintained until reset by the operator after appropriate action has been taken to verify the fault and to correct the condition as required. In the example of FIG. 2, gun 3 is exhibiting a fault condition. The presentation in FIG. 2 includes additional optional features on a task bar such as a date/time clock 106, a fault flag zone 108 and a status indicator 110 to show the operator if the system is actively online. Other menu selections 112 allow the operator to review data for a specific gun by clicking on a selected faceplate 50 and then making a menu selection 112 such as to view a data graph 114, calibration history 116, fault records 118 and so on.

FIG. 3 illustrates a typical data graph 114 screen for one of the dispensing guns. In accordance with another aspect of the invention, a visual representation of the monitored fluid flow parameter P such as for example the pressure signal, is generated on a suitable graph such as a time line 120. Included on the graph may be color coded alarm bands. In this example, the alarm bands include a warning band 122 having upper and lower limits 122*a* and 122*b* respectively and a fault band 124 having upper and lower limits 124*a* and 124*b* respectively. The alarm bands may be color coded in a manner complementary to the color coded faceplates 50 (FIG. 2). FIG. 3 illustrates an example wherein the selected gun is operating within the prescribed limits. In this particular example, the graph of FIG. 3 is plotting the delta pressure, however, note that the base pressure or fire pressure may also be monitored if so desired by a menu selection 126.

In accordance with another aspect of the invention, the data that is plotted visually is also logged in memory for later retrieval or transfer to another computer. This data not only includes the actual pressure signal readings for a selected time period but also may include such information as the calibration data and fault records. The amount of data stored will be limited only by the amount of available storage capacity of the system.

FIG. 4 is similar to FIG. 3 but illustrates an example of how a fault condition is graphically displayed for gun 3 (FIG. 2). The data graph P is shown going outside the prescribed alarm band and a data point 130 is used to mark the precise time that the fault occurred. This data point 130 may be color coded in a complementary manner to the faceplates 50. The system may be programmed to log faults as well as warning occurrences.

Figure 5:
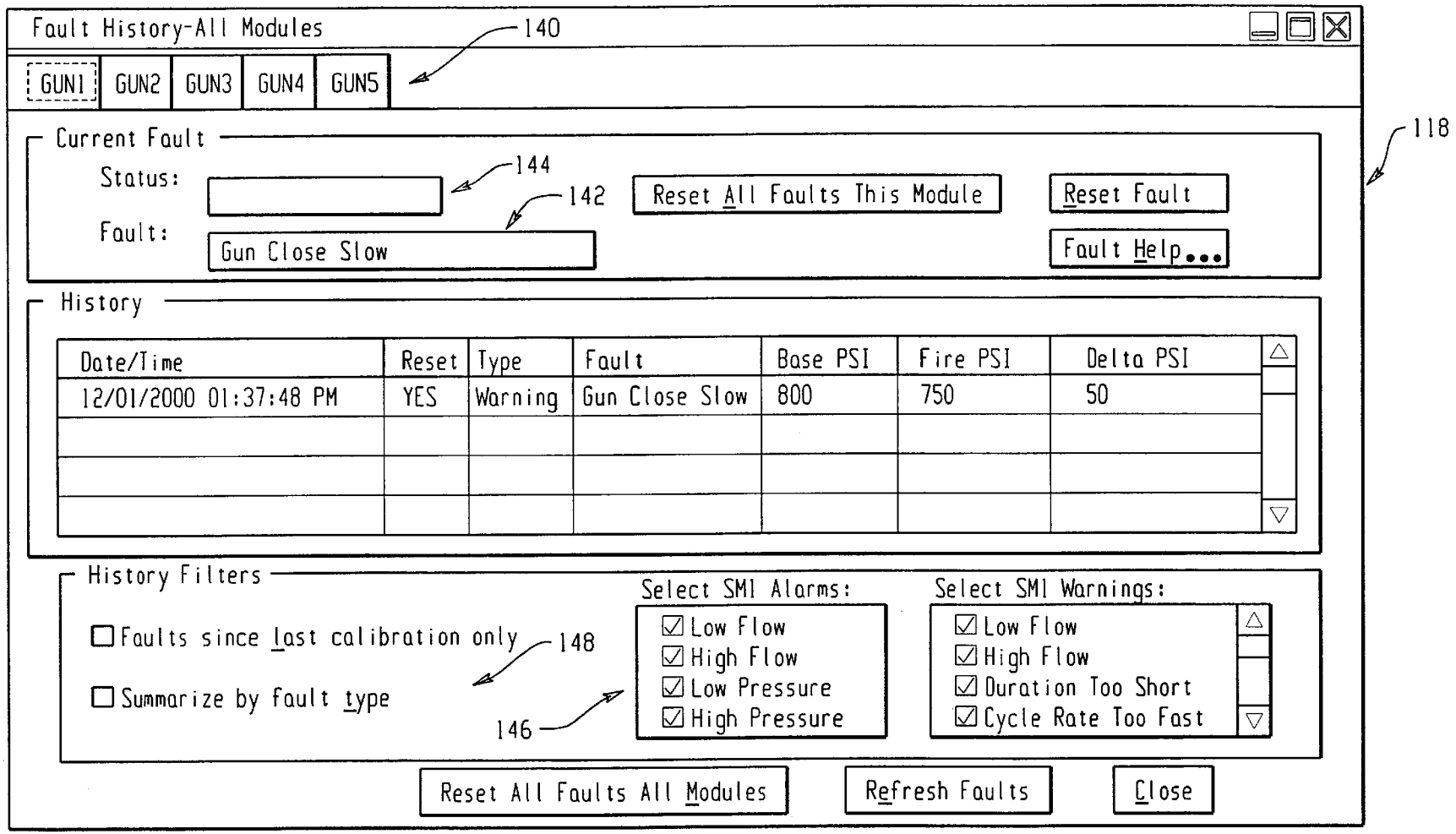
FIG. 5 illustrates an exemplary fault history visual representation.

FIG. 5 illustrates an example of a fault history 118 (FIG. 2) screen. The screen in this example is a spreadsheet type chart that provides a history or log of the fault occurrences. As shown in FIG. 5, a separate log may be used for each dispensing device 10 and selected by clicking on the appropriate menu button 140. A fault description window 142 may be provided as well as a status window 144 to indicate the type of fault that was detected. In this example, the fault was a warning, not an alarm. Additional selection menus 146 permit the operator to select which historical records to display as well as data filter selections 148.

Figure 6A:
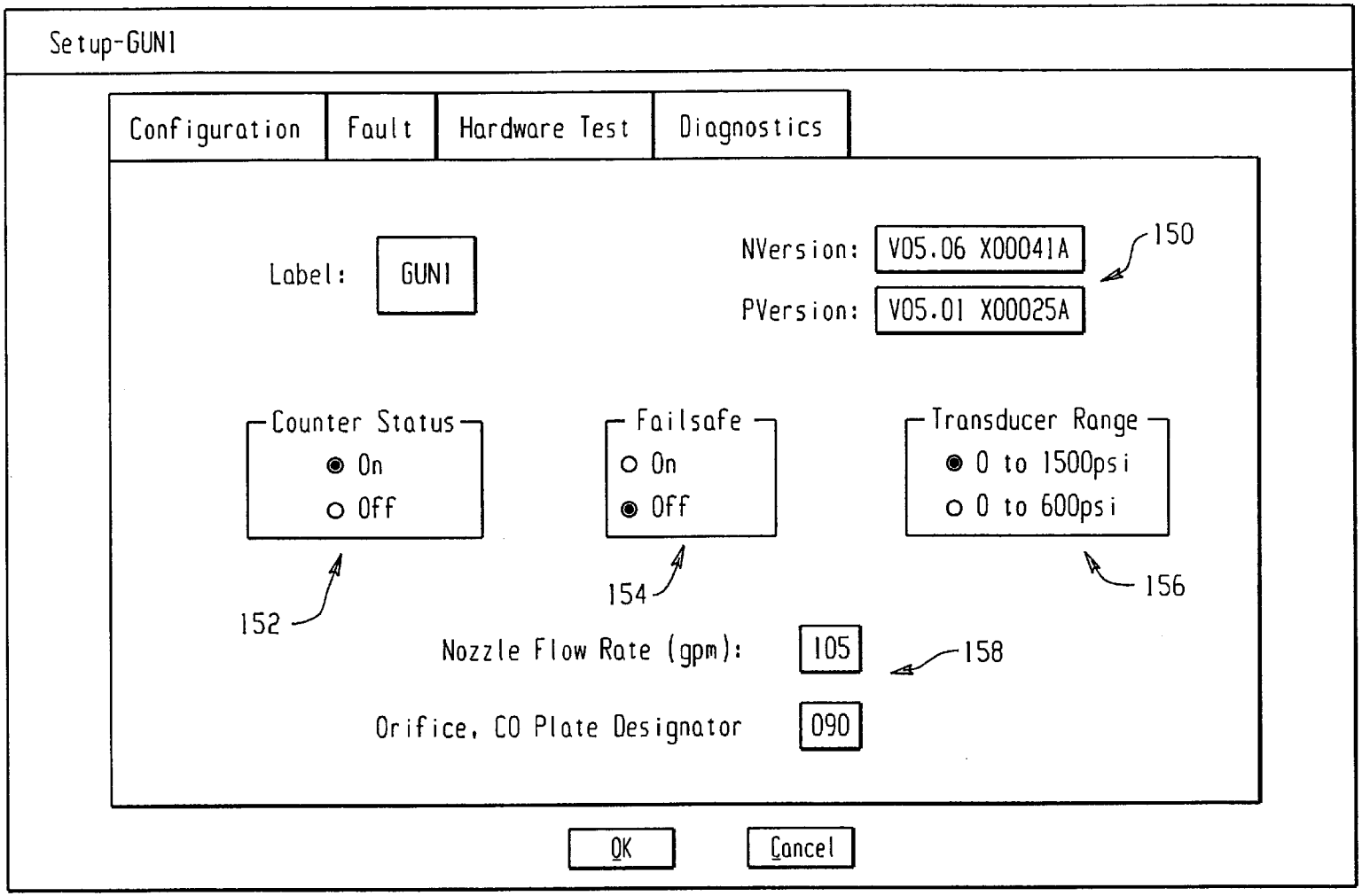
FIGS. 6A and 6B illustrate exemplary screens for configuration selections.
Figure 6B:
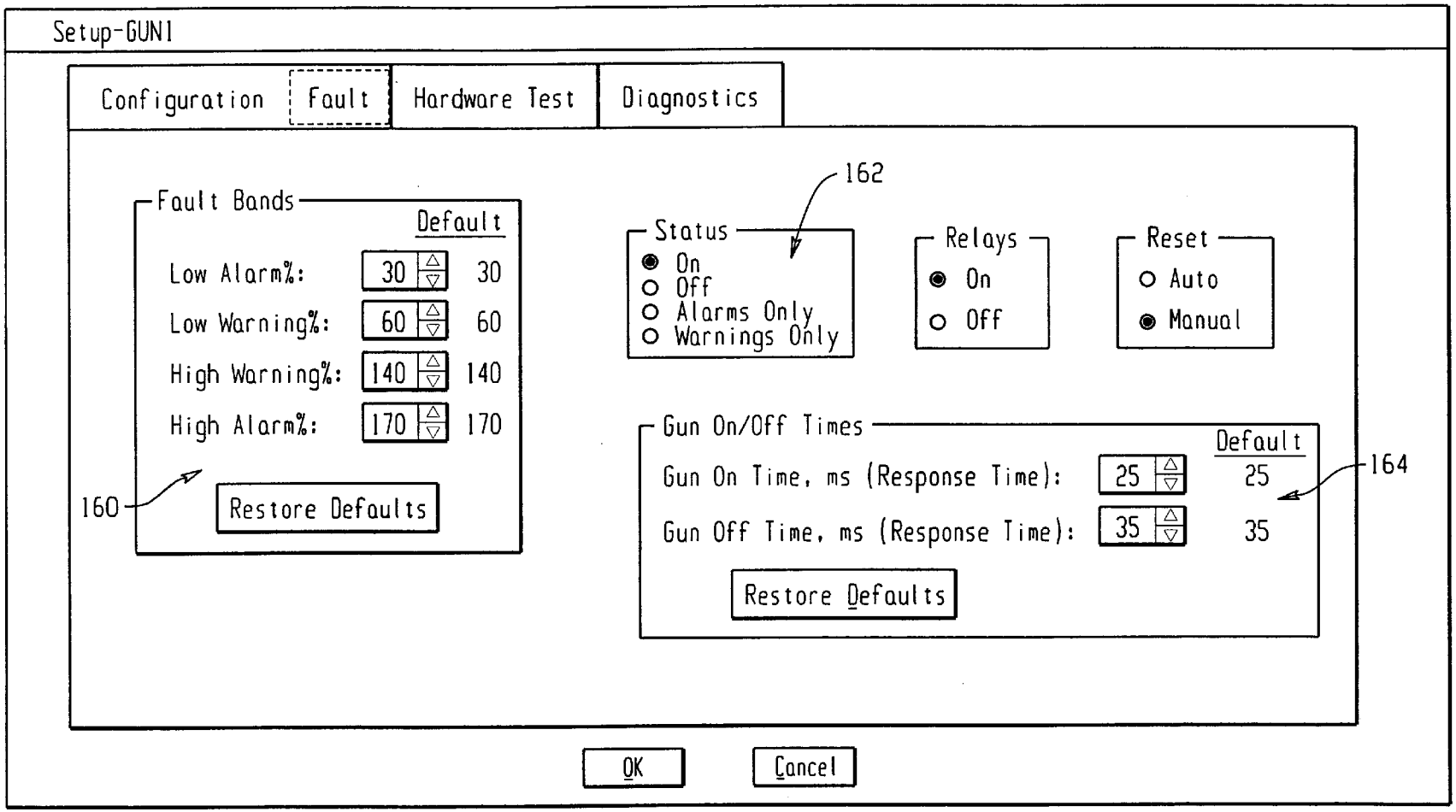

FIGS. 6A and 6B illustrate additional aspects of the invention including various gun configuration menu selections and fault limit selections. In FIG. 6A, software versions 150 are set as well as various parameters such as counter status 152 for tracking the number of times each dispensing device is actuated, fail safe detection 154 and transducer operating ranges 156. Calibrated flow rates 158 may also be entered. These data selections are intended to be exemplary in nature and should not be construed in a limiting sense. The particular data monitored and logged may be selected based on each particular application. FIG. 6B illustrates an example of a menu selection for the alarm bands 160, alarm status 162 and calibration values for the gun on/off times 164. Gun on/off times are calculated values based on the detected pressure changes that occur when the dispensing device is opened and closed.

In accordance with another aspect of the invention, the operator control 16 may be interfaced with a conventional web browser for online access (block 32 in FIG. 1). For applications in which the operator control 16 has access to the Internet, such as through a modem or other network connection, the Help menu (FIG. 2) may include a link to a web site that contains access to an online manual such as may be used for troubleshooting or setup.

The invention thus provides an improved monitoring system by which an operator may selectively group a plurality of dispensing devices in a single screen, with selectable coding for indicating normal and fault conditions. Data logging and graphing are also provided for both historical analysis and other analytical techniques such as statistical process control or SPC. The data graphing may also be used for trend analysis and preventative maintenance. Calibration and additional setup data values may be stored to assist with such analyses. Fault conditions and warnings are date and time stamped and logged, as well as the type of fault and the alarm bands that were being used at the time the fault occurred.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. A system for monitoring a fluid dispensing apparatus, comprising:

a plurality of fluid dispensing devices;

a control device for controlling individually at least one operating parameter of each said dispensing devices;

a monitor control for individually monitoring a characteristic of fluid flow through each said dispensing device and producing a respective signal representative thereof;

a visual display; and a display control that is coupled to said monitor control and receives said respective signals from said monitor control related to each said characteristic for each dispensing device;

said display control providing a respective visual representation of said characteristic for each said dispensing device; said visual representations being displayed in selectable groupings on said visual display to permit an operator to monitor operation of said dispensing devices.

2. The system of claim 1 wherein said display control is coupled to said monitor control across a network to permit an operator to monitor operation of said dispensing devices from a remote location.

3. The system of claim 1 wherein each said visual representation comprises a graphical representation of each said signal relative to a time line.

4. The system of claim 1 wherein each said visual representation includes a color code to distinguish normal and fault conditions of each dispensing device.

5. The system of claim 1 wherein each said visual representation comprises a graphical representation of each said signal relative to a time line and a visual display of alarm limits for each signal.

6. The system of claim 5 wherein said alarm limits are graphically displayed as warning and fault bands on a time line.

7. The system of claim 1 wherein each said visual representation comprises data representations of each said characteristic, each said data representation being visually associated with a respective dispensing device graphic on said visual display.

8. The system of claim 1 wherein said signals are stored and can be later graphically displayed in a selected manner by an operator.

9. The system of claim 1 wherein said signals are date and time stamped.

10. The system of claim 1 wherein said display control compares said signals with respective limits and generates fault signals when a fault is detected; each said detected fault being date and time stamped and separately displayable on said visual display.

11. A system for monitoring a fluid dispensing apparatus, comprising:

a plurality of fluid dispensing devices;

control means for controlling individually at least one operating parameter of each said dispensing devices;

monitor means for individually monitoring a characteristic of fluid flow through each said dispensing device and producing a respective signal representative thereof;

a visual display; and a display control means that is coupled to said monitor means and receives said respective signals from said monitor means related to each said characteristic for each dispensing device;

said display device providing a respective visual representation of said characteristic for each said dispensing device; said visual representations being displayed in selectable groupings on said visual display to permit an operator to monitor operation of said dispensing devices.

12. A method for monitoring a fluid dispensing apparatus, comprising the steps of:

operating a plurality of fluid dispensing devices;

individually controlling at least one operating parameter of each said dispensing devices;

individually monitoring a characteristic of fluid flow through each said dispensing device and producing a respective signal representative thereof; and visually displaying a respective visual representation of said characteristic for each said dispensing device; said visual representations being displayed in selectable groupings on a visual display to permit an operator to monitor operation of said dispensing devices.

13. The method of claim 12 wherein said visual representations comprise a graphical display of each said signal on a time line with alarm bands.

14. The method of claim 13 comprising the step of date and time stamping fault occurrences and visually displaying fault occurrences for each dispensing device.

15. A method for monitoring a fluid dispensing apparatus, comprising the steps of:

operating a plurality of fluid dispensing devices;

individually monitoring a characteristic of fluid flow through each said dispensing device and producing a respective signal representative thereof; and visually displaying a respective visual representation of said characteristic for each said dispensing device; said visual representations being displayed in selectable groupings on a visual display to permit an operator to monitor operation of a plurality of said dispensing devices on a single display screen.

16. The method of claim 15 wherein said visual representations comprise a graphical display of each said signal on a time line with alarm bands.

17. The method of claim 15 comprising the step of date and time stamping fault occurrences and visually displaying fault occurrences for each dispensing device.

18. The method of claim 15 wherein said visual representations are color coded to distinguish normal and fault conditions of each dispensing device.

* * * * *